US006944984B1

(12) United States Patent
Grasmann

(10) Patent No.: US 6,944,984 B1
(45) Date of Patent: Sep. 20, 2005

(54) SIGN REPRESENTATION DEVICE

(76) Inventor: Josef Grasmann, Weissenbach 18, A-3242 Texing (AT)

( * ) Notice: Subject to any disclaimer, the term of this patent is extended or adjusted under 35 U.S.C. 154(b) by 296 days.

(21) Appl. No.: 10/110,625

(22) PCT Filed: Oct. 5, 2000

(86) PCT No.: PCT/AT00/00260

§ 371 (c)(1),
(2), (4) Date: Apr. 15, 2002

(87) PCT Pub. No.: WO01/29809

PCT Pub. Date: Apr. 26, 2001

(30) Foreign Application Priority Data

Oct. 15, 1999 (AT) ..... A 1740/99

(51) Int. Cl.[7] ..... G09F 3/00
(52) U.S. Cl. ..... 40/447; 40/446
(58) Field of Search ..... 40/447, 446; 400/132, 400/127, 134.2, 134.4, 134

(56) References Cited

U.S. PATENT DOCUMENTS

| | | | | |
|---|---|---|---|---|
| 909,444 A * | 1/1909 | Newell | | 40/447 |
| 3,270,447 A * | 9/1966 | Langdon | | 40/447 |
| 3,724,110 A | 4/1973 | Meyerson | | |
| 4,186,394 A | 1/1980 | Bobak et al. | | |
| 5,772,440 A | 6/1998 | Ida | | |

FOREIGN PATENT DOCUMENTS

| | | |
|---|---|---|
| DE | 1 623 800 | 4/1970 |
| FR | 1 465 490 | 1/1967 |
| GB | 990 094 | 4/1965 |
| GB | 2 317 490 | 3/1998 |
| JP | 11 065492 | 3/1999 |

* cited by examiner

*Primary Examiner*—Cassandra Davis
(74) *Attorney, Agent, or Firm*—Collard & Roe, P.C.

(57) ABSTRACT

An apparatus for displaying letters, numbers or symbols, especially for marking the prices of goods, with displaceable movable members arranged in a basic body. In order to provide an apparatus of the kind mentioned above which is small and versatile and allows displaying letters, numbers and symbols without requiring a store of the various characters and without requiring any complex puzzle-like composition of the letters, numbers or symbols in order to produce the desired information, it is provided that the movable members (3) are held in the opening (2) by means of a sliding seat or a loose fit.

19 Claims, 19 Drawing Sheets

SIGN REPRESENTATION DEVICE

CROSS REFERENCE TO RELATED APPLICATIONS

Applicant claims priority under 35 U.S.C. §119 of Austrian Application No. A 1740/99 filed Oct. 15, 1999. Applicant also claims priority under 35 U.S.C. §365 of PCT/AT00/00260 filed Oct. 5, 2000. The international application under PCT article 21(2) was not published in English.

BACKGROUND OF THE INVENTION

1. Field of the Invention

The present invention relates to an apparatus for displaying letters, numbers or symbols, as well as an apparatus for setting said apparatus.

2. Description of the Prior Art

The attachment of letterings such as prices, descriptions, notes, technical specifications or the like to merchandise is of particular importance nowadays. Consumers are becoming more and more demanding and wish to be informed as precisely as possible about the products that they wish to purchase. Thus it is important for the consumer to obtain information for example about the exact price, the material and the technical data of the product on the one hand, and it offers the vendor or seller of the products the advantage on the other hand that the consumer feels well-informed for the moment without any additional advice having to be given.

It is therefore certainly common practice all over the world to provide the exhibited goods in a shop display or sales locations with price tags or other kinds of lettering. The consumer can thus determine in a very simple manner in passing whether the price/performance ratio concerning specific merchandise is grounds for purchasing the article or not.

The apparatuses generally used for displaying the price are usually small rails in which individual letters or numbers printed on small plates are inserted.

It is further also common practice to print price labels on paper and to attach the same to film disposed on the merchandise.

Small plastic cubes are also used where each cube contains a number, a letter or a symbol (currency symbol) and in this way the various different prices or other data can be composed.

The disadvantage of these apparatuses according to the state of the art is that the vendor of the goods who wishes to mark the same with prices or other data needs to go to the respective goods with a storage box of letters, numbers or symbols in order to compose the various prices laboriously from the individual parts. There is a high likelihood that a number of the individual parts have already been lost or that especially the number or letter which is necessary for the price or desired text to be composed is not present because all of these numbers/letters have already been used for other goods. Generally it can be said that the vendor must always ensure that a sufficient number of individual blocks with letters, numbers or symbols are available, as otherwise a marking of the goods with the desired price or text is not possible.

The use of printed price or information labels has the disadvantage that they need to be printed first, must then be transported to the respective goods and must be inserted there in a sleeve. If the price labeling is wrong, the wrong label can only be replaced after a renewed printout of the label, which might possibly occur at a different location. An additional factor is that any change in the price requires the discarding of the old price tag.

From U.S. Pat. No. 3,724,110 an apparatus is known in which openings are disposed in a matrix-like manner in a base part, with movable members being held displaceably in said openings, with each movable member being displaceable from a first position in which a face side of the movable member is visible from a visible surface of the base part to a second position in which said face surface is substantially disposed in a non-visible way. Magnetic balls are used as movable members which can be conveyed by another magnet to the visible position. In order to arrest the balls in the visible position, additional holding means are disposed on the base part such as magnetic rails or edges or lips which project into the opening, which edges or lips act upon the ball and arrest the same in its position. In order to release this catch it is then necessary to press against the ball by means of a pin-like object for example in order to release the same from the catch. It is usually sufficient, however, to strongly shake the base part in order to move the balls again to their non-visible positions. The disadvantage in the apparatus as described in U.S. Pat. No. 3,724,110 A is the fact that the introduction of the balls into the openings is relatively difficult due to the edges and lips which close off said openings. Moreover, these edges and lips are worn off relatively quickly, so that the arresting of the balls in their visible positions is no longer possible.

Apparatuses are further known from DE 1 623 800 A, GB 990 094 A, FR 1 465 490 or GB 2 317 490 A which work according to the same principle as U.S. Pat. No. 3,724,110. In these cases the actuation of the movable members occurs by means of current or a fluid. The use as a display means for price labels for example is thus not possible or only within limits because the drive system of the movable members impose limits concerning the miniaturization of such a display apparatus.

SUMMARY OF THE INVENTION

It is therefore the object of the present invention to provide an apparatus of the kind mentioned above which is small and handy and allows displaying letters, numbers and symbols without requiring a store of different characters and without requiring any inconvenient puzzle-like composition of the letters, numbers or symbols for producing the desired information. It is a further object of the present invention to provide an apparatus of the kind mentioned above which makes do without using fluids and/or current for moving the movable members and which allows at the same time arresting the movable members in the openings without any additional auxiliary means.

This is achieved by the characterizing features of claim 1.

The provision of a loose fit and a sliding seat between opening and movable member allows on the one hand the simple displacement of the movable members in the opening. On the other hand, the movable member is immediately fixed in its momentary position after the release. Additional edges or lips which also require additional production efforts are not necessary.

The features of claims 3 to 4 allow displaying a large variety of characters with a fixed predetermined number of openings per character. These features also allow displaying characters of every language, i.e. any desired font and also special characters without having to exchange the apparatus per se.

As a result of the feature of claim 5 it is not necessary to build the individual characters by displacing several movable members, but the displacement of one single member is sufficient in order to make the character visible for the viewer. This variant for a solution is particularly suitable for characters that need to be changed or adjusted only rarely.

The features of claim 6 allow displaying any desired character, preferably also the known seven-segment displays, as are used in LCD displays for example.

The feature of claim 7 allows fastening additional information in the groove which is printed on a piece of paper, cardboard or plastic.

The feature of claim 8 allows fastening the apparatus in accordance with the invention by means of at least one pin on the respective ware.

The feature of claim 9 allows fastening other different fixing elements to the apparatus in accordance with the invention. In this way the apparatus can be fastened flexibly to the respective ware.

The feature of claim 10 prevents that the movable members can be pushed out of the openings during improper displacement and setting of the characters.

It is a further object of the present invention to provide an apparatus for displacing movable members in a base part (1).

This is enabled in accordance with the invention by the characterizing features of claims 11 to 19.

The features of claim 11 allow in a simple manner to bring the movable elements to an arrangement corresponding to the character to be displayed. By compressing the holding elements, the pin-like elements engage successively in the openings of the apparatus for displaying the characters and thus displace the movable members to a defined starting position and then to a position corresponding to the character to be displayed.

The feature of claim 16 allows choosing the characters to be displayed from a template of characters to be displayed.

The features of claim 13 describe a preferred embodiment of the setting apparatus.

The features of claim 14 allow an easy ejection of the apparatus in accordance with the invention from the setting chamber.

The features of claim 19 describe an alternative embodiment of a setting apparatus in accordance with the invention which is characterized by fewer individual parts.

The alternative ejection mechanism according to the claims 15 to 19 allow the braked ejection of the base part of the price label as well as a straight-lined insertion of the same into the setting chamber.

BRIEF DESCRIPTION OF THE DRAWING

The invention is now explained in closer detail by reference to the enclosed drawings, wherein:

FIG. 8 shows an apparatus in accordance with the invention for displaying characters with a pin which is pierced through;

DETAILED DESCRIPTION OF PREFERRED EMBODIMENTS

Figure 1:
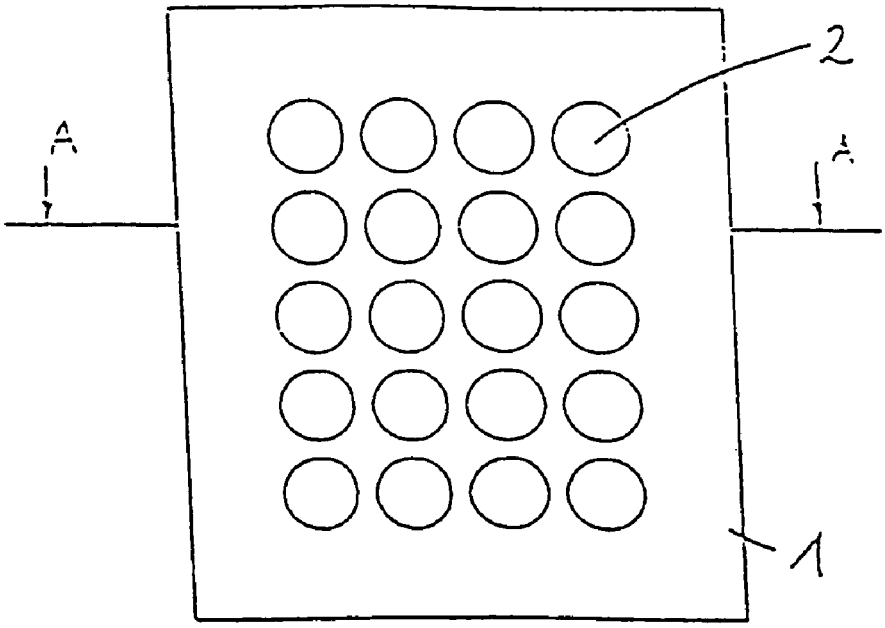
FIG. 1 shows an apparatus in accordance with the invention for displaying characters in a front view.

FIG. 1 shows an apparatus in accordance with the invention for displaying characters in a front view. Several openings 2 are provided in a basic body 1. The openings are arranged as bores. The arrangement is made in the present example in the form of a matrix. Any desired character (even special characters) can be represented very easily in this way.

Figure 2:
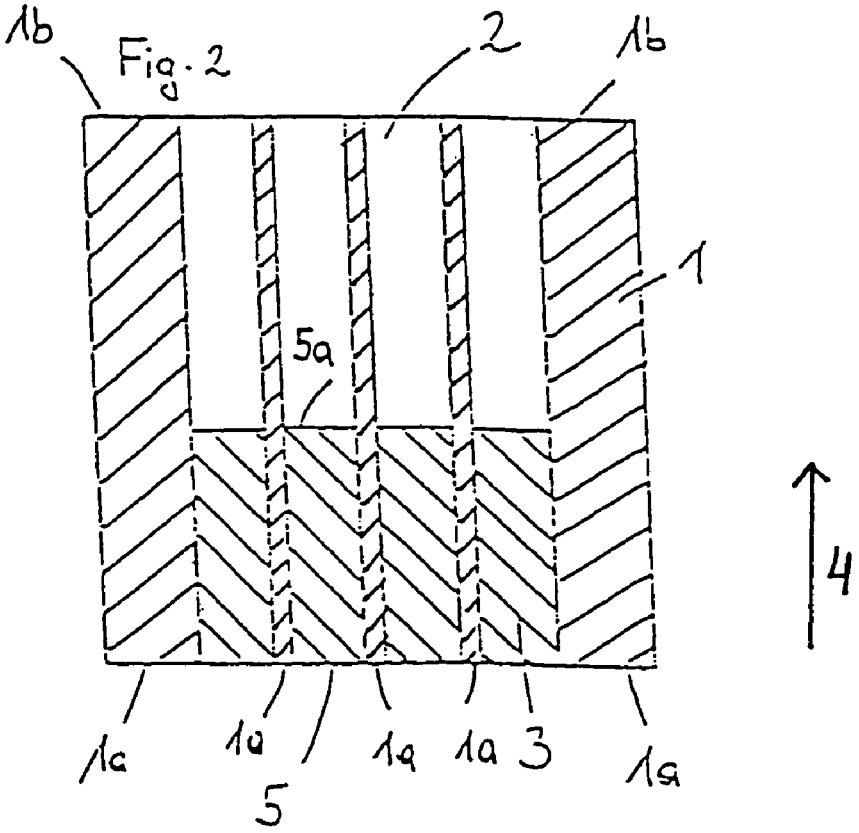
FIG. 2 shows an apparatus in accordance with the invention for displaying characters in a sectional view along the line AA of FIG. 1.

FIG. 2 shows the apparatus in accordance with the invention in a sectional view. The movable members 3, which are arranged displaceably along the bores 2, can be recognized clearly. The movable members 3 are fitted into the openings 2 by means of a sliding seat (loose fit), so that any unintentional falling of the movable members 3 out of the openings 2 is not possible. The movable members 3 and the basic body 1 can be provided with different colors.

The effect in accordance with the invention also occurs when the movable members 3 and the basic body 1 are of the same color (with the exception of the color black), because the movable members 3 which are pushed into the basic body 1 do not remain visible even in the case of identical colors (with the exception of the color black) and therefore give the impression of a dark lettering.

A viewer who is situated in front of the apparatus in accordance with the invention and looks in the direction of arrow 4 sees the basic part 1 and all movable members 3 since their face sides 5 are flush with the surface of the basic part 1. Assuming that in the present example all face surfaces 5 of the movable members 3 are flush with the surface facing the viewer, the viewer will see a matrix as shown in FIG. 1.

Figure 3:
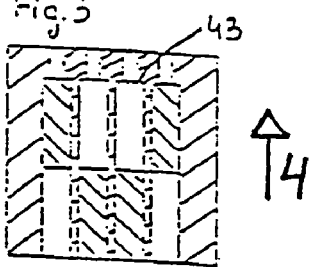
FIG. 3 shows an apparatus in accordance with the invention for displaying characters with stop strips in the openings.

FIG. 3 shows a number of the movable members 3 which are pushed rearwardly in the openings 2 (away from the viewer). Due to the insertion depth which depends on the diameter of the openings 2 (which are formed in the present case as bores), no light falls on these rearwardly pushed movable members. They are therefore not visible to the viewer who looks in the viewing direction 4. In this way it is possible to display any desired character by the combination of visible and non-visible movable members 3.

As is shown in FIG. 3, the openings 2 (bores) can additionally be tapered in their rear end zone which is averted from the viewer. The constriction is made to such an extent that the movable elements 3 cannot inadvertently be pushed out of the basic part 1, e.g. during the setting of the characters.

Figure 4:
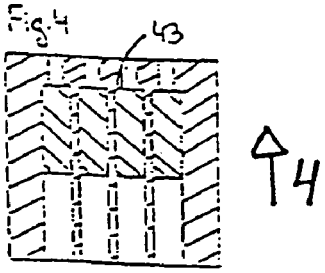
FIG. 4 shows an alternative apparatus in accordance with the invention for displaying characters with the movable members in a non-visible position.

FIG. 4 shows a basic part 1 in which all movable members 3 are pushed rearwardly. The viewer can no longer see the movable members 3 in this case. He only sees the basic part 1 or the openings 2. The sliding seat of the movable members 1 in the basic body 3 prevents the movable members 3 from falling out of the basic body 1.

Figure 5:
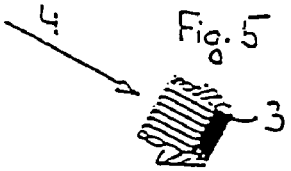
FIG. 5 shows an alternative apparatus in accordance with the invention for displaying characters with the movable members in a non-visible position.
Figure 5A:
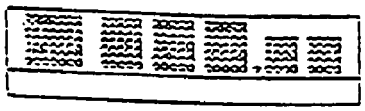
Figure 6:
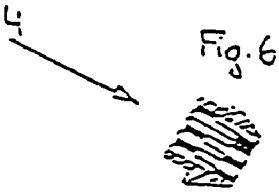
FIG. 6 shows an alternative apparatus in accordance with the invention for displaying characters with the movable members in a non-visible position.
Figure 6A:
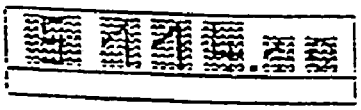

FIGS. 5 and 6 each show alternatively arranged basic parts 1 which produce a slight inclined position of the apparatus and thus helps the viewer who looks at the apparatus from an oblique view from above to read the set characters. The entire matrix-like arrangement of the movable members is again visible to the viewer in FIG. 5 (FIG. 5*a*), whereas in FIG. 6 certain characters are already set or displayed (FIG. 6*a*).

Figure 7:
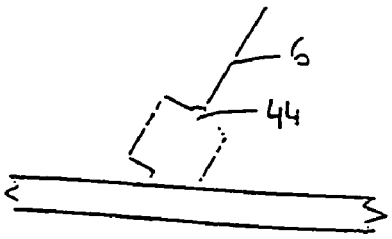
FIG. 7 shows an apparatus in accordance with the invention for displaying characters with inserted piece of paper.

FIG. 7 shows an apparatus in accordance with the invention, with a groove 44 being arranged on basic part 1 in which a piece of paper 6 is inserted. The paper can contain additional information concerning the merchandise thus labeled or any other desired text.

Figure 8:
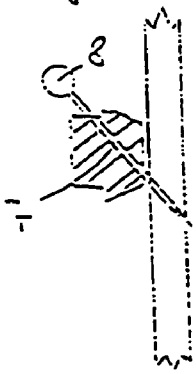

In FIG. 8, the apparatus in accordance with the invention is provided with at least one additional bore 7 into which a pin 8 is inserted for example. It is used for fastening the apparatus in accordance with the invention to the merchandise such as a garment for example.

Figure 9:
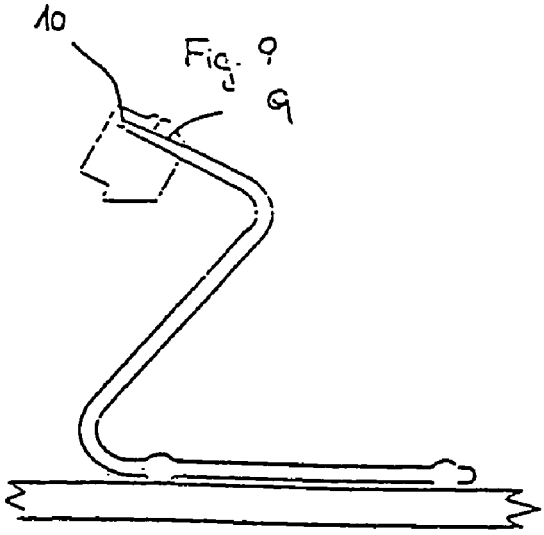
FIG. 9 shows an apparatus in accordance with the invention for displaying characters with a holding element.

FIG. 9 shows an alternative form of fastening the apparatus in accordance with the invention by way of a holder 9 which has been inserted in an additional opening 10 in basic part 1.

As a result of the additional bores 7 and openings 10, a large number of fastening possibilities are possible which can be adjusted to the various materials and shapes of the merchandise to be labeled.

The basic parts as described in FIGS. 1 through 9 are all provided with cylindrical openings 2 (bores), with said openings having a matrix-shaped arrangement. The movable members 3 must in this case also be provided with a cylindrical shape, with a sliding seat (loose fit) being again provided between the movable members 3 and the respective openings 2 in the basic body 1.

Other forms and arrangements of the openings 2 in the basic part 1 and, obviously, also the movable members 3 are possible.

Figure 10:
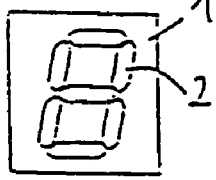
FIG. 10 shows an alternative form and arrangement of the openings in the base part of an apparatus in accordance with the invention.

FIG. 10 shows for example the arrangement of segment-like openings 2 in the basic part 1. This arrangement and configuration of the openings 2 is sufficient for the display of numbers and simple letters. The function is the same as in the matrix-like arrangement of the cylindrical openings 2 with cylindrical movable members 3.

Figure 11:
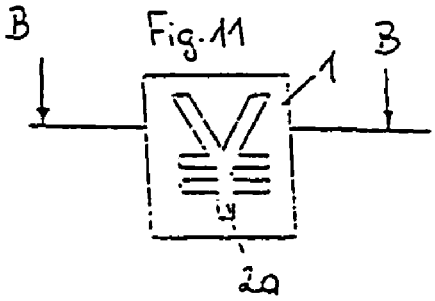
FIG. 11 shows a further alternative form and arrangement of the openings in the base part of an apparatus in accordance with the invention.
Figure 11A:
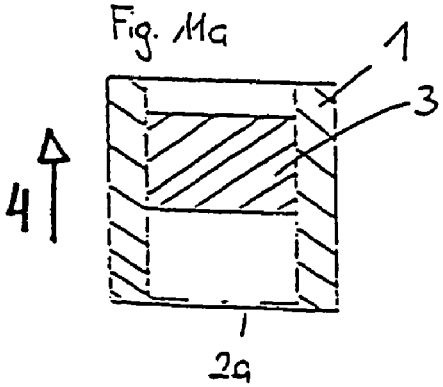
FIG. 11*a* shows a sectional view along the line BB of FIG. 11.

FIG. 11 shows the arrangement of a symbol-shaped opening 2 in a basic part 1. The arrangement of the entire opening 2 can have the same shape as the symbol. In this case the associated movable member must be provided with the shape of the symbol. The embodiment as shown in FIG. 11*a* is simpler to manufacture, however. The surface of the basic part 1 which is situated in the direction of view 4 of the viewer comprises an opening 2*a* which corresponds to the symbol to be displayed. The further progress of the opening 2 is as usual cylindrical or cuboid. Accordingly, the movable member 3 can also be provided with a cylindrical or cuboid shape and need not necessarily be adjusted to the complex shape of the character (symbol) to be displayed. The function is also the same as in all other cases.

Figure 12:
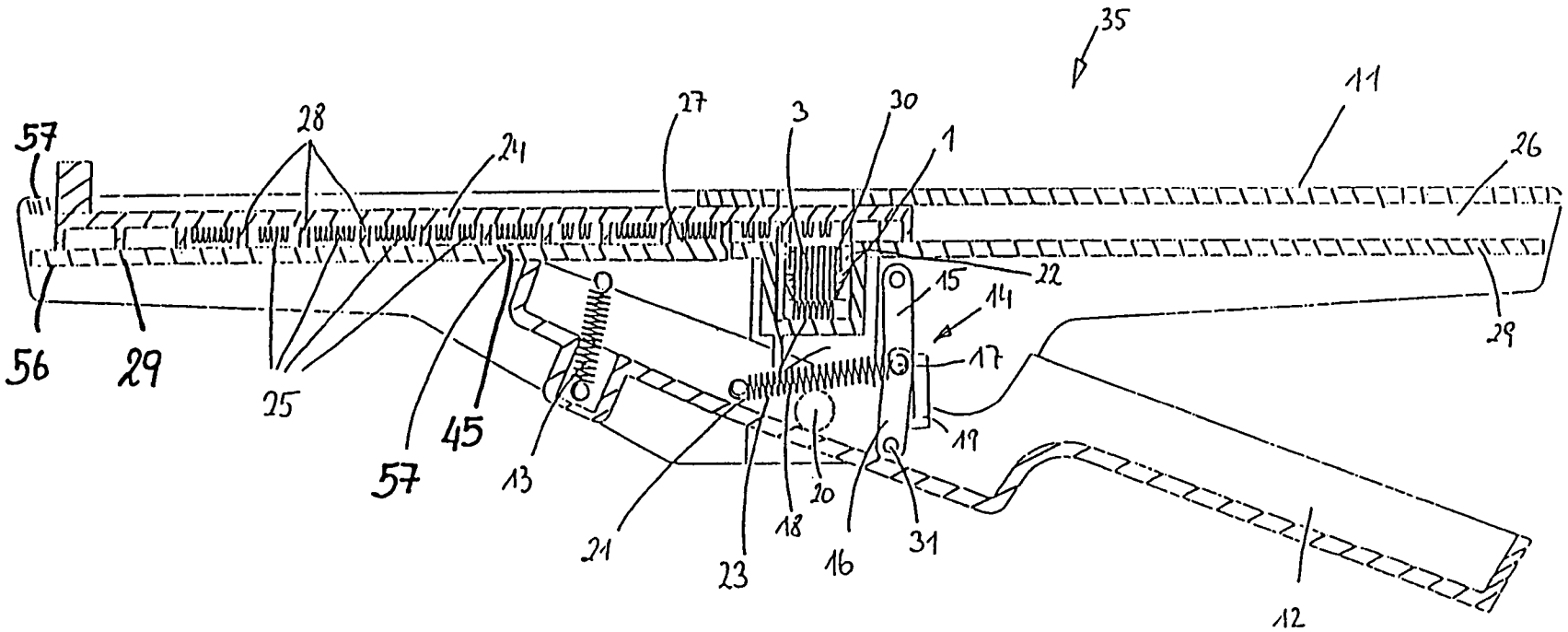
FIG. 12 shows a sectional view of a first embodiment of an apparatus in accordance with the invention for setting the desired characters in the idle position along the line of intersection CC of FIG. 16.

FIG. 12 shows an apparatus 35 for performing the method for setting characters of the apparatus in accordance with the invention according to claims 1 through 10.

An upper holding part 11 is connected with a lower holding part 12 via a spring 13 and a lever combination 14 consisting of a lever 15 which is rotatably held on the upper holding part 11 and a lever 16 which is rotatably held on the lower holding part 12. The two levers 15, 16 are also mutually rotatably connected. At the connection point 17 of the two levers 15, 16 a spring attacks which is fastened at its lower end in the lower holding part 12. The lower holding part 12 thus forms with the upper holding part 11 from its middle zone a substantially V-shaped element. The upper holding part 11 further comprises two openings 33, 33*a*.

The lever combination 14 is thus arranged in such a way that in the case of a bending stress the same bends out according to a predetermined direction. This is achieved in the present example in such a way that the upper lever 15 is provided with an extension 19 through which an arrangement in true alignment of the two levers 15, 16 with one another is prevented. In this way the lever combination 14 can merely bend out in the direction under a bending stress in which the extension 19 is disposed.

The lower half 12 is further rotatably fastened to pins 20, 20*a* (pin 20*a* is not visible in FIG. 12). The pins 20, 20*a* are disposed on two brackets 21 and 21*a* (bracket 21*a* is not visible in FIG. 12) which are held in a vertically displaceable manner in the upper holding part 11. The brackets 21, 21*a* are each provided with an opening 32, 32*a*.

Figure 15A:
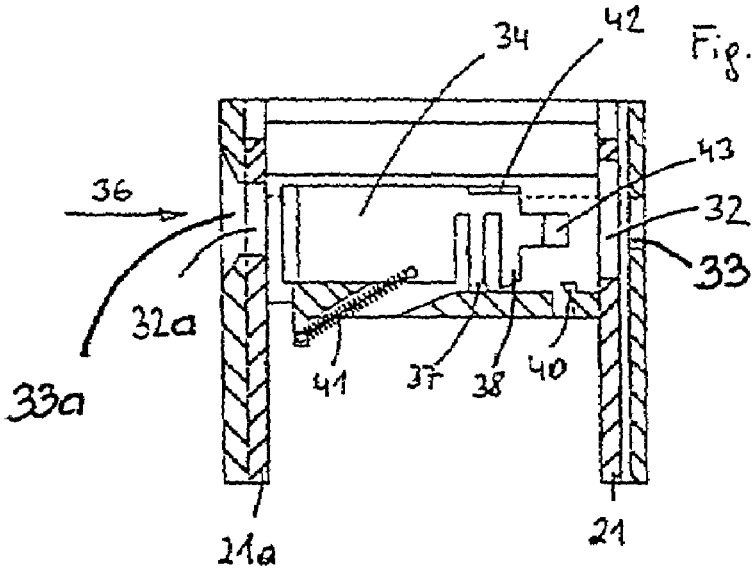
FIG. 15 shows a sectional view of an apparatus in accordance with the invention for setting the apparatus for displaying characters along the line of intersection DD of FIG. 16.
Figure 15B:
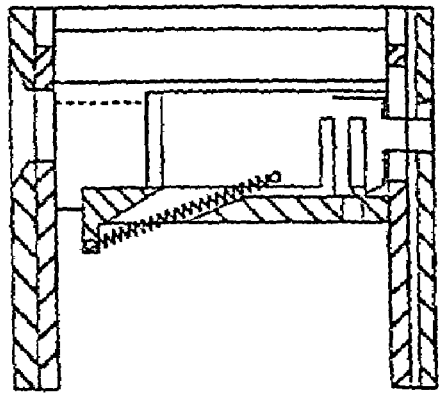
Figure 15C:
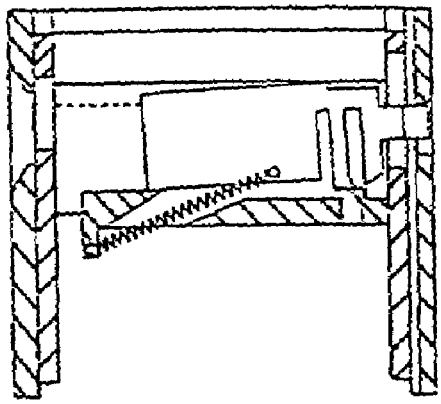

The upper holding part 11 is further provided in its middle zone with a substantially U-shaped setting chamber 22 which is upwardly open. Pin-like calibrating elements 23 are disposed in the floor of said setting chamber, which calibrating elements are upwardly aligned. The dimensions of the setting chamber 22 are dimensioned in such a way that an apparatus in accordance with the invention, as described in claims 1 through 9, fits into the space. The openings 32, 32*a* of said brackets 21, 21*a* are aligned in the idle position in such a way that jointly with the openings 33, 33*a* a continuous opening is produced in the apparatus for performing the method for setting characters of the apparatus in accordance with the invention according to claims 1 to 10. The setting chamber is further provided with an ejection mechanism (FIG. 15).

Several templates 24 are disposed above the setting chamber 22 in a substantially U-shaped guide rail 26 in the upper holding part 11 adjacent to one another. The templates 24 are displaceable along the longitudinal axis of the upper holding part 11 and are provided at their lower side with area separators 28 which divide each template into different, evenly large areas. Every area on its part comprises pin-like setting elements 25 which are aligned downwardly. The pin-like setting elements 25 correspond precisely to the negative or positive of the character to be displayed. The number of the templates substantially depends on the number of characters to be displayed or set. Thus, an apparatus for displaying a three-digit price with cent values and currency symbol requires six templates (see FIGS. 5*a*, 6*a*).

The floor plate 29 of the guide rail 26 is provided with tongue-like projections 45 which are provided with a slightly elevated design in a zone 27, so that during the displacement of the templates 24 they are subjected to a slightly increased displacing resistance and allow a defined latching. The length of the elevation corresponds precisely to the distance of two area separators 28. In this way a displacement in areas and a latching of the templates is possible. One area each, depending on the setting of the operator, is disposed precisely above the setting chamber 22 in which the apparatus 30 in accordance with the invention has been inserted.

Figure 16:
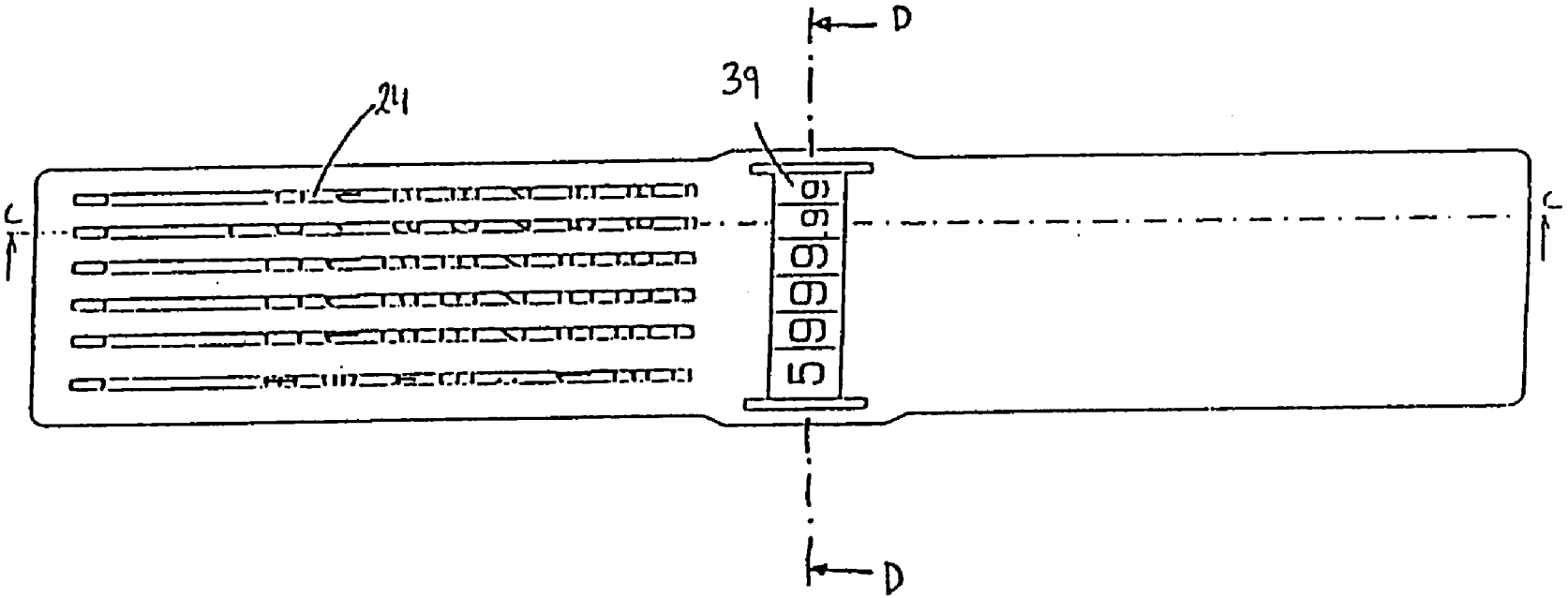
FIG. 16 shows a top view of an apparatus in accordance with the invention for setting the apparatus for displaying characters.
Figure 16A:
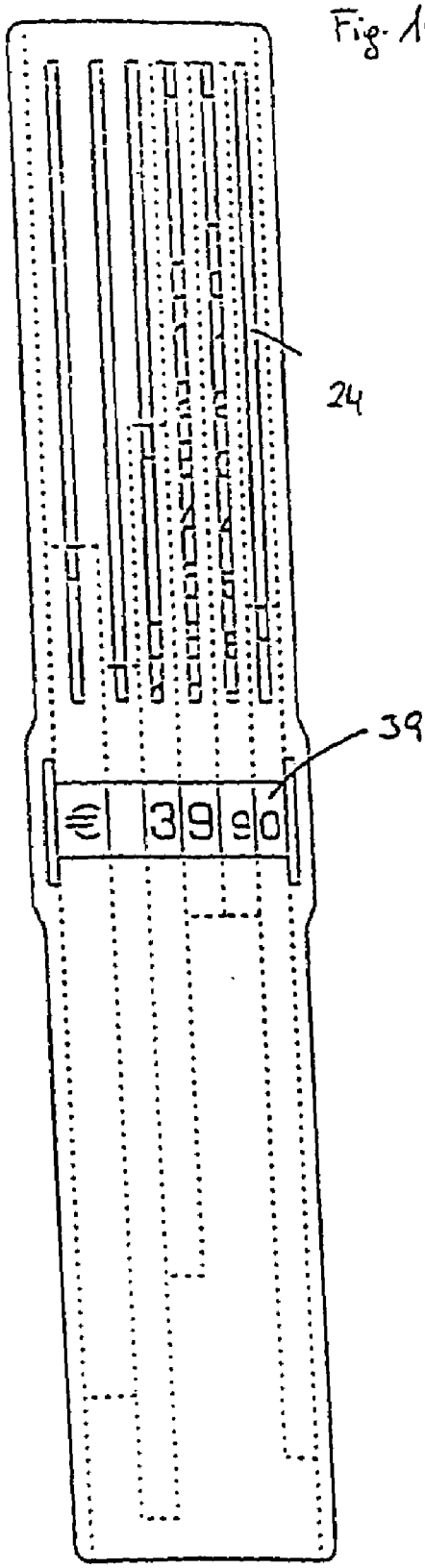
FIG. 16*a* shows a top view of an apparatus in accordance with the invention for setting the apparatus for displaying characters with a display element.
Figure 17:
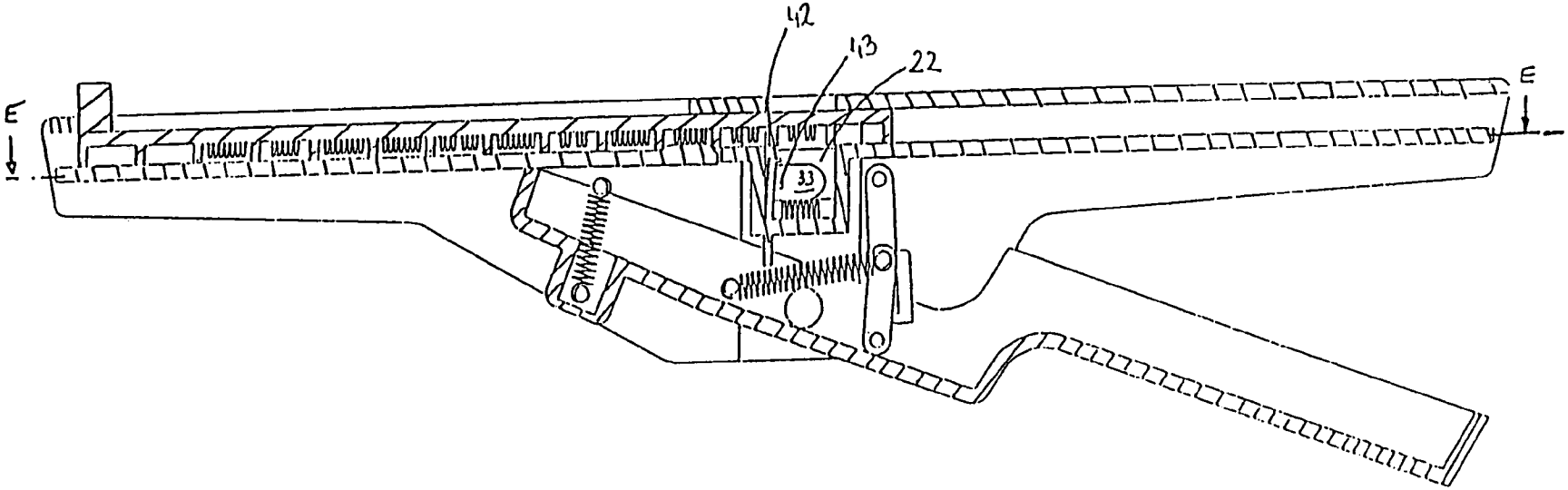
FIG. 17 shows a sectional view of an apparatus in accordance with the invention along the line of intersection CC of FIG. 16 for performing the method in accordance with the invention without an apparatus for displaying characters.

FIGS. 16 and 16*a* each show a top view of a setting apparatus in accordance with the invention. One can clearly see the displaceable templates 24, by means of which the user can choose the characters to be set by displacing the templates. The momentary setting can be checked by the user in an inspection window 39.

In a first step the apparatus 30 in accordance with the invention is pushed into the setting chamber 22 of the apparatus 35 (FIG. 12). Then the user sets the characters which are to be displayed subsequently by means of the movable members 3 and the basic part 1. The upper side of the templates 24 is ideally provided with a lettering which shows the character which is disposed in the section of area below. Then the handle of the lower holding part 12 is pressed against the handle of the upper holding part 11 until a position as shown in FIG. 13 has been reached.

The lower holding part 12 rotates about a point 31 in FIG. 12, as a result of which the pins 20, 20*a* plus the brackets 21, 21*a* move downwardly. As a result of the forced guidance of the brackets 21, 21*a*, the pivot of the lower holding part 12 displaces in the absolute system. The point 31 in FIG. 12 moves to the right.

Figure 13:
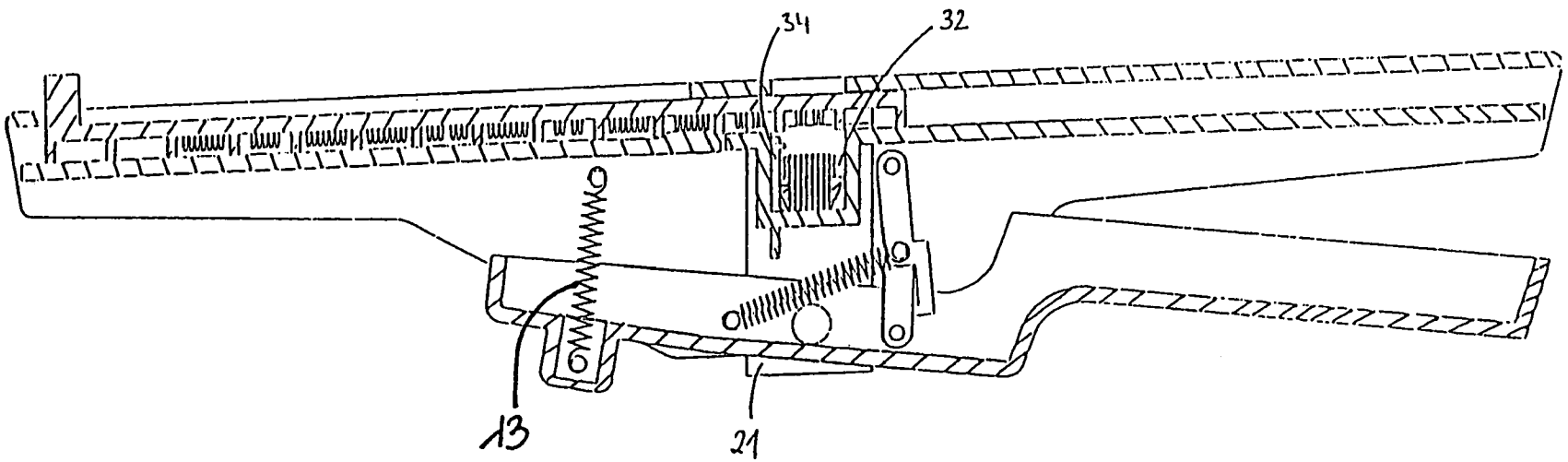
FIG. 13 shows a sectional view of an apparatus in accordance with the invention in the calibrating position along the line of intersection CC of FIG. 16.
Figure 14:
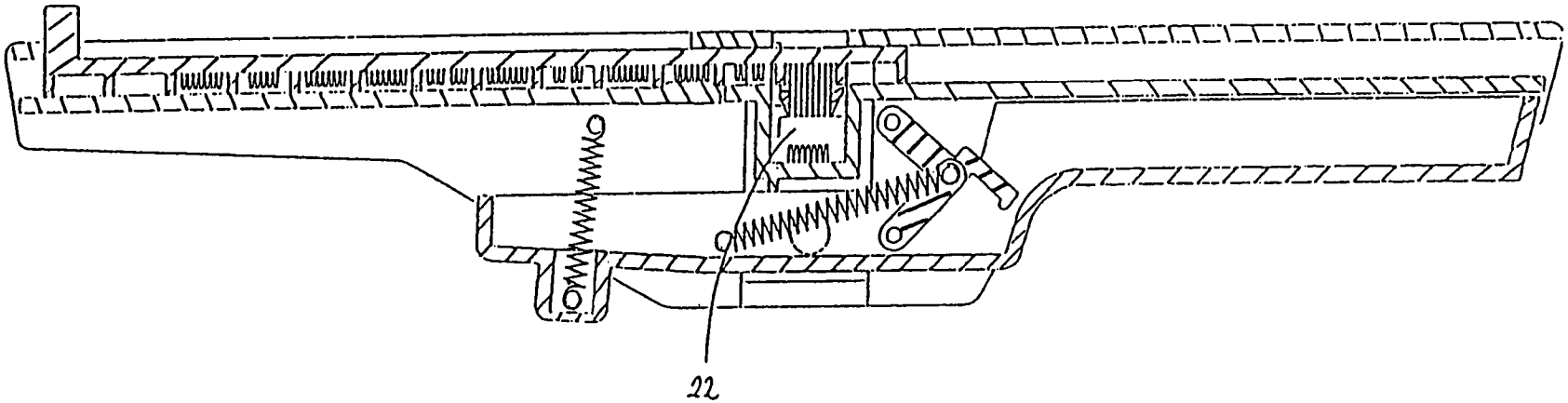
FIG. 14 shows a sectional view of an apparatus in accordance with the invention in the setting position along the line of intersection CC of FIG. 16.

Upon reaching the position from FIG. 13, the apparatus exerts an increased resistance against the occurring pincer-like movement because on the one hand the spring 13 compresses the two parts with increased force and on the other hand the lever combination 14, due to the displaced brackets 21, 21*a* and the thus changed geometry, is subjected to buckling and thus blocks any further bringing together of the two holding parts 11, 12.

The spring 18 acts in this process additionally against the buckling of the lever combination 14.

At the same time with the movement of the upper and lower holding parts 11, 12 to a position as shown in FIG. 13, the apparatus 30 in accordance with the invention is pressed by means of brackets 21, 21*a* onto the pin-like calibrating elements 23 which are disposed in the setting chamber 22, as a result of which the movable members 3 of the apparatus in accordance with the invention are all aligned substantially flush with the surface of the basic part 1 of the apparatus in accordance with the invention.

If the pressure on the upper and lower holding part 11, 12 is further increased despite the increased resistance as is shown in a position as illustrated in FIG. 13, the buckling of the lever combination 14 occurs from a defined action of force. In this way the entire lower holding part 12 displaces upwardly in a substantially parallel manner, because on the one hand the spring force of the spring 13 in its one end zone on the one hand and the force applied by the user in its other end zone acts in the direction towards the upper holding part 11.

As a result of the sudden, substantially translation upward movement of the lower holding part 12, the two brackets 21, 21*a* also move upwardly and thus also thereby move the basic part 1 upwardly, as a result of which the same is pressed against the pin-like setting elements 25 of the template 24.

As a result, the movable members 3 in the basic part 1 are aligned in such a way that the effect in accordance with the invention occurs and the viewer can read individual characters.

After the release of the two holding parts 11, 12 the apparatus 35 returns to its initial position. The brackets 21, 21*a* also move to their initial position, so that the openings 32, 32*a* again form a continuous opening with the openings 33, 33*a*.

The ejection mechanism which was initially tensioned by the insertion of the apparatus 30 in accordance with the invention into the apparatus 35 in the direction of arrow 36 now ejects the apparatus 30 in accordance with the invention against the direction of insertion (FIGS. 15*a, b, c*) after the holding part 12 has been moved to its initial position.

During the insertion of the apparatus 30 into the setting chamber 22, an ejection bracket 34 which comprises shoulders 37, 38 and an entrainment element 43 is displaced by the entrainment of the entrainment element 43 in the insertion direction 36. The lower edge of the ejection bracket 34 moves along the floor of the setting chamber 22. A hook-like nose 40 is disposed there which is arranged in the floor of the setting chamber 22. The shoulder 38 is inclined in such a way that during the movement of the ejection bracket 34 along the floor of the setting chamber 22 and particularly over the nose 40, the ejection bracket 34 is slightly lifted at first and is thus moved with the shoulder 38 over the hook-like nose 40. The ejection bracket 34 is fastened to a spring 41 below the floor of the setting chamber 22, so that it will automatically return to the horizontal position again once it has been moved over the nose 40.

Once the shoulder 38 has been moved over the nose 40, the same latches behind said nose 40 by the spring force of spring 41 and the apparatus in accordance with the invention is fixed in its position in the setting chamber. After ending the setting process the ejection bracket 34 is lifted again by the vertical movement of the apparatus 30 in accordance with the invention (which movement is produced by the vertical movement of the brackets 21, 21*a*) and the thereby occurring entrainment of the entrainment element 42 and the shoulder 38 is moved over the nose 40, as a result of which the spring 41 brings the ejection bracket 34 back to its initial position again and thus ejects the apparatus 30 in accordance with the invention.

Figure 18:
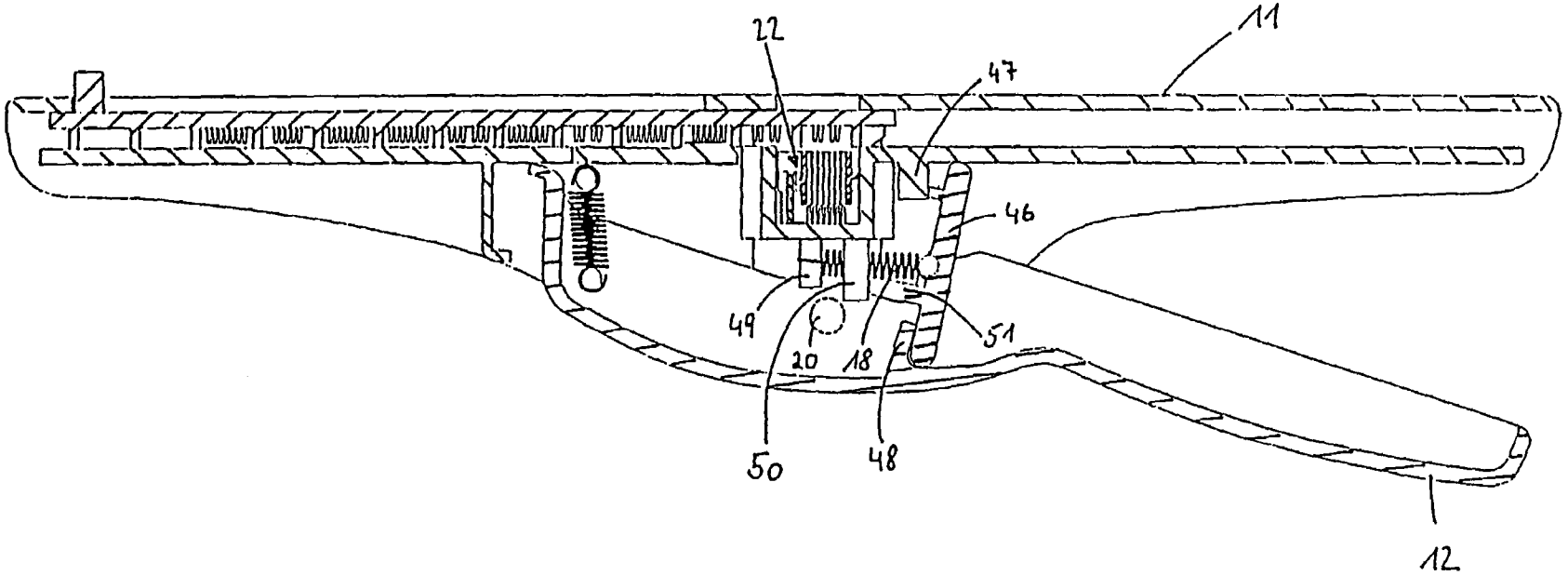
FIG. 18 shows a sectional view of a second embodiment of an apparatus in accordance with the invention for setting the desired character in the idle position along the line of intersection CC of FIG. 16.

FIG. 18 shows a further possible embodiment of the apparatus 35 in accordance with the invention for setting the desired characters. The two levers 15, 16 of the first variant are replaced by a single lever 46. It rests with its two end zones on brackets 47, 48 which are arranged on the upper holding part 11 and on the lower holding part 12. The lever 46 is fastened via a spring 18 with the upper holding part 11, and more precisely with a bridge 49 which projects from the lower side of the setting chamber 22. The bearing of lever 46 is thus provided in an overhung manner, meaning that it is merely held in its position by spring 18 and the clamping between the upper holding part 11 and the lower holding part 12. The lower holding part 12 is provided for this reason with projections (not shown) which are guided in a groove of the side wall of the upper holding part 11, so that the lower holding part 12 is guided on the upper holding part 11. An additional bridge 50 is disposed on the lower side of the setting chamber 22, on which a support 51 rests which is rigidly connected with the lever 46. During the assembly of the apparatus 35 in accordance with the invention for setting the desired characters, the lever 46 can already be mounted on the upper holding part 11, even before the lower holding part 12 is mounted on the upper holding part 11.

As has already been described in the preceding embodiment of the setting apparatus 35, the two holding parts 11, 12 are compressed at the handle sections (FIG. 19, FIG. 20), as a result of which the one end zone of lever 46 which rests on the upper holding part 11 slides in the direction towards the handle sections and both the spring 18 as well as spring 13 are tensioned in this way.

Figure 19:
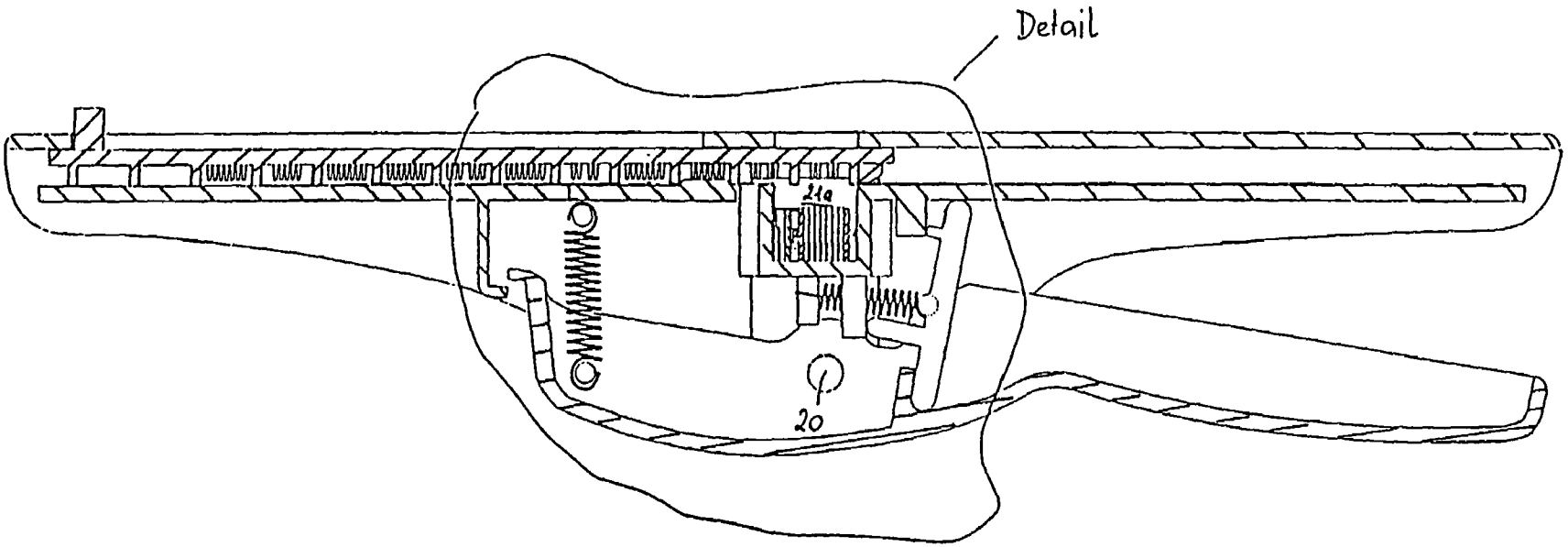
FIG. 19 shows a sectional view as shown in FIG. 18, but in the calibrating position of the setting apparatus.
Figure 20:
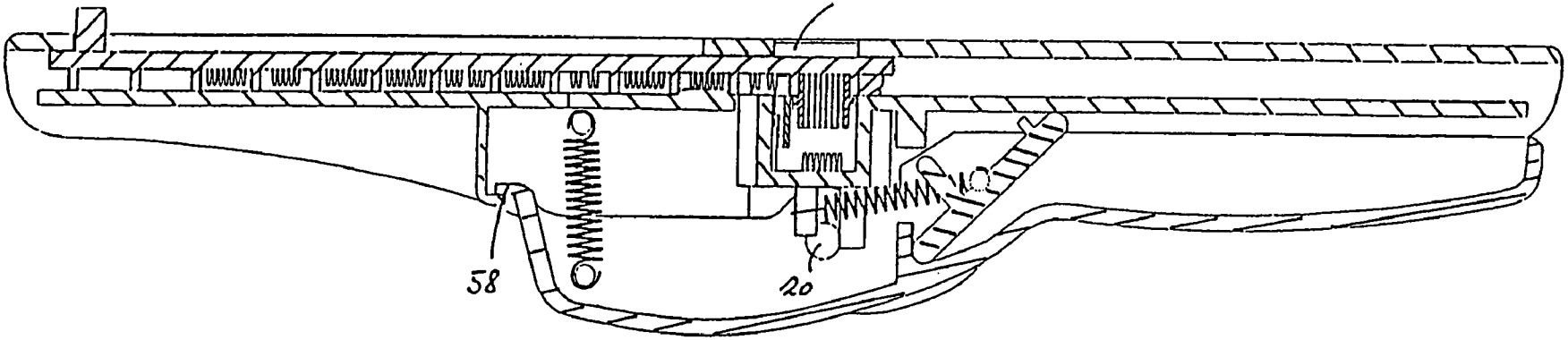
FIG. 20 shows a sectional view as in FIGS. 18 and 20, but in the setting position of the setting apparatus.

In the setting chamber 22, the brackets 21, 21*a* are pushed downwardly by the pins 20, 20*a* as a result of the movement of the lower holding part 12. The lower holding part 12 performs at first a rotational movement whose center of rotation is situated in the lower end zone of the lever 46. As a result, the part of the lower holding element which is disposed to the left of the center of rotation moves downwardly at first, which also includes the pins 20, 20*a* as well as the brackets 21, 21*a*, as a result of which the basic part 1 which is tensioned between the brackets 21, 21*a* is pressed against the calibrating elements 23 disposed in the setting chamber floor 22 (FIG. 19). In analogy to the embodiment as described above and for the same reasons, the upper end zone of the lever 46 travels in the subsequent section of the movement in the direction towards the handle sections of the upper and lower holding element 11, 12, through which the lower holding element performs an upwardly directed, substantially translational movement (FIG. 21) and the brackets are again moved upwardly by the pins 20, 20*a*, as a result of which subsequently the basic part 1 is pressed against the pin-like setting elements which are disposed on the templates 24 and the movable members 3 are displaced accordingly. The lower holding part 12 rests in this process with an edge 58 on the upper holding part 11.

The last described variant comes with the advantage that the lever combination 14 of the first variant can be replaced by a single lever.

Figure 21:
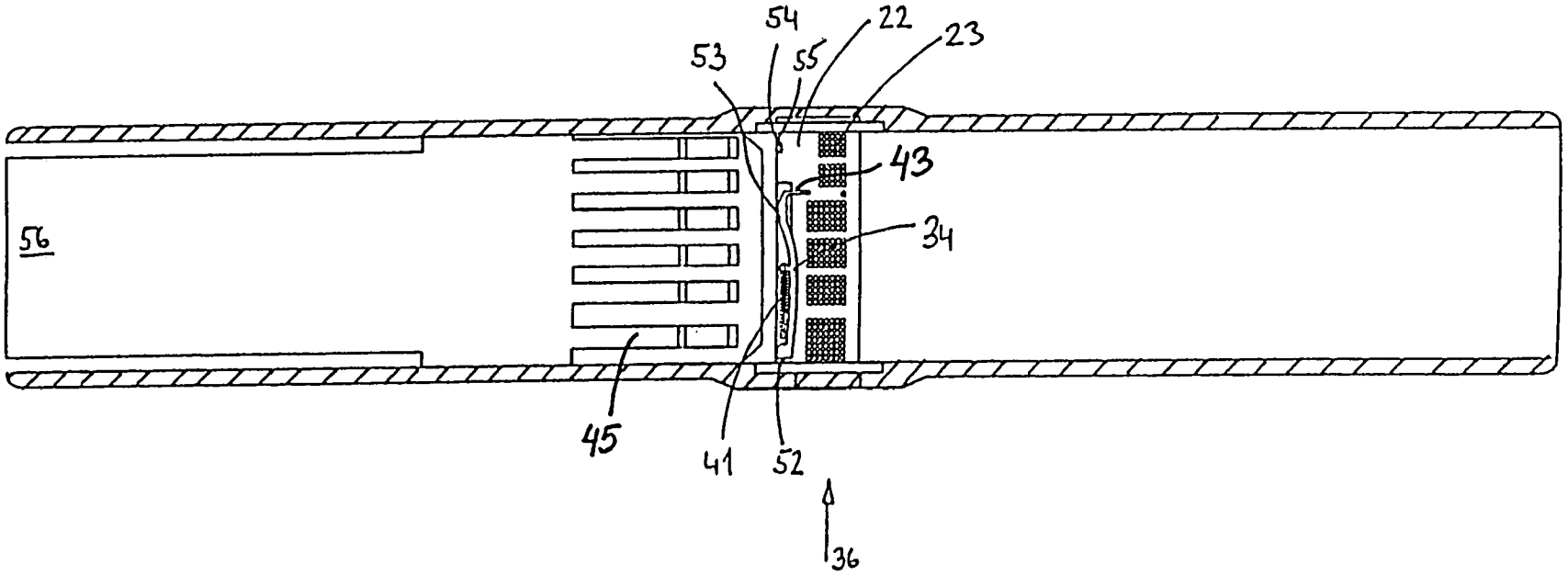
FIG. 21 shows a sectional view along the line EE of FIG. 17 with an alternative ejection mechanism of the setting chamber in the idle position.
Figure 21A:
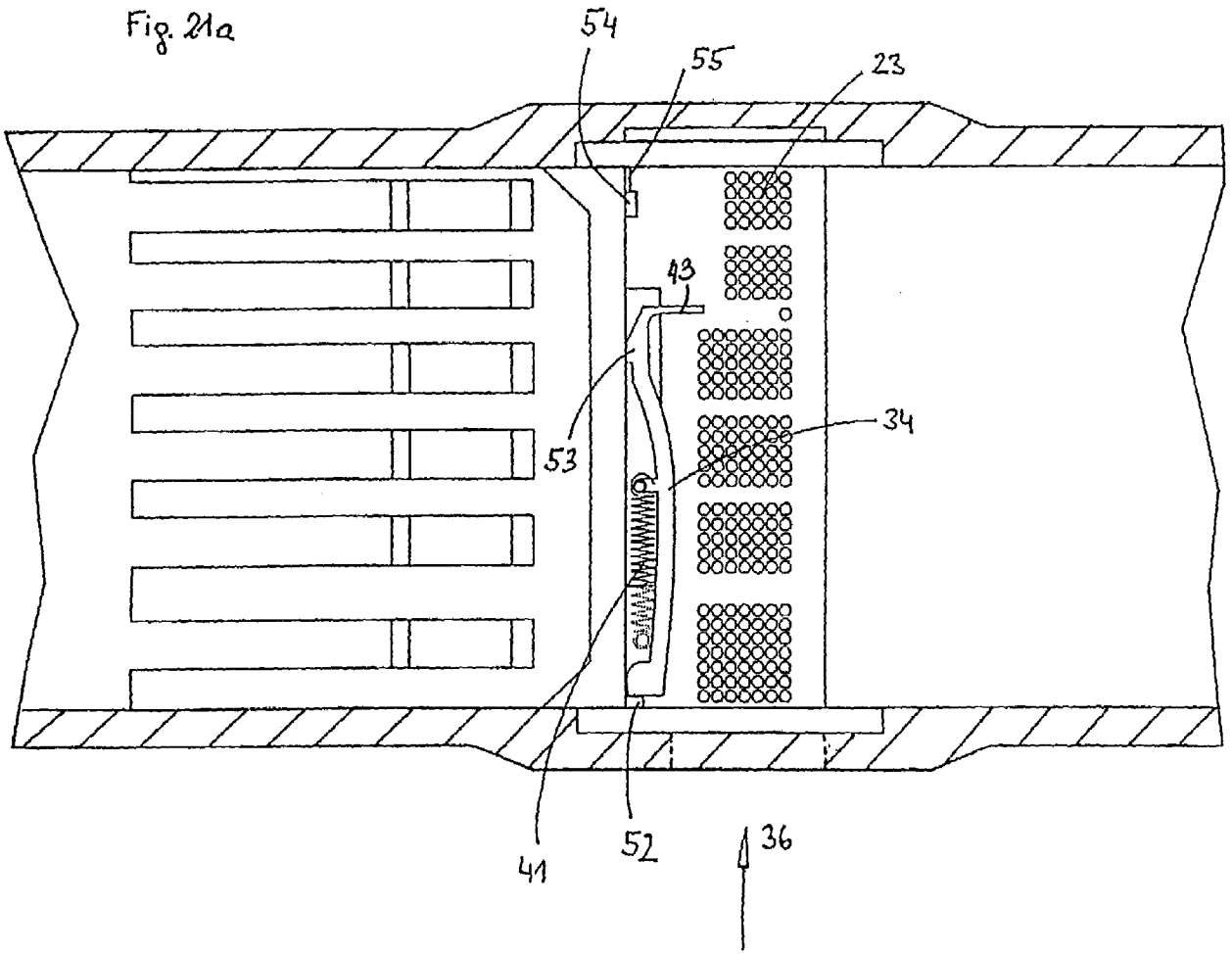
FIG. 21*a* shows a sectional view along the line EE of FIG. 17 with an alternative ejection mechanism of the setting chamber in the idle position in a detailed view.
Figure 22:
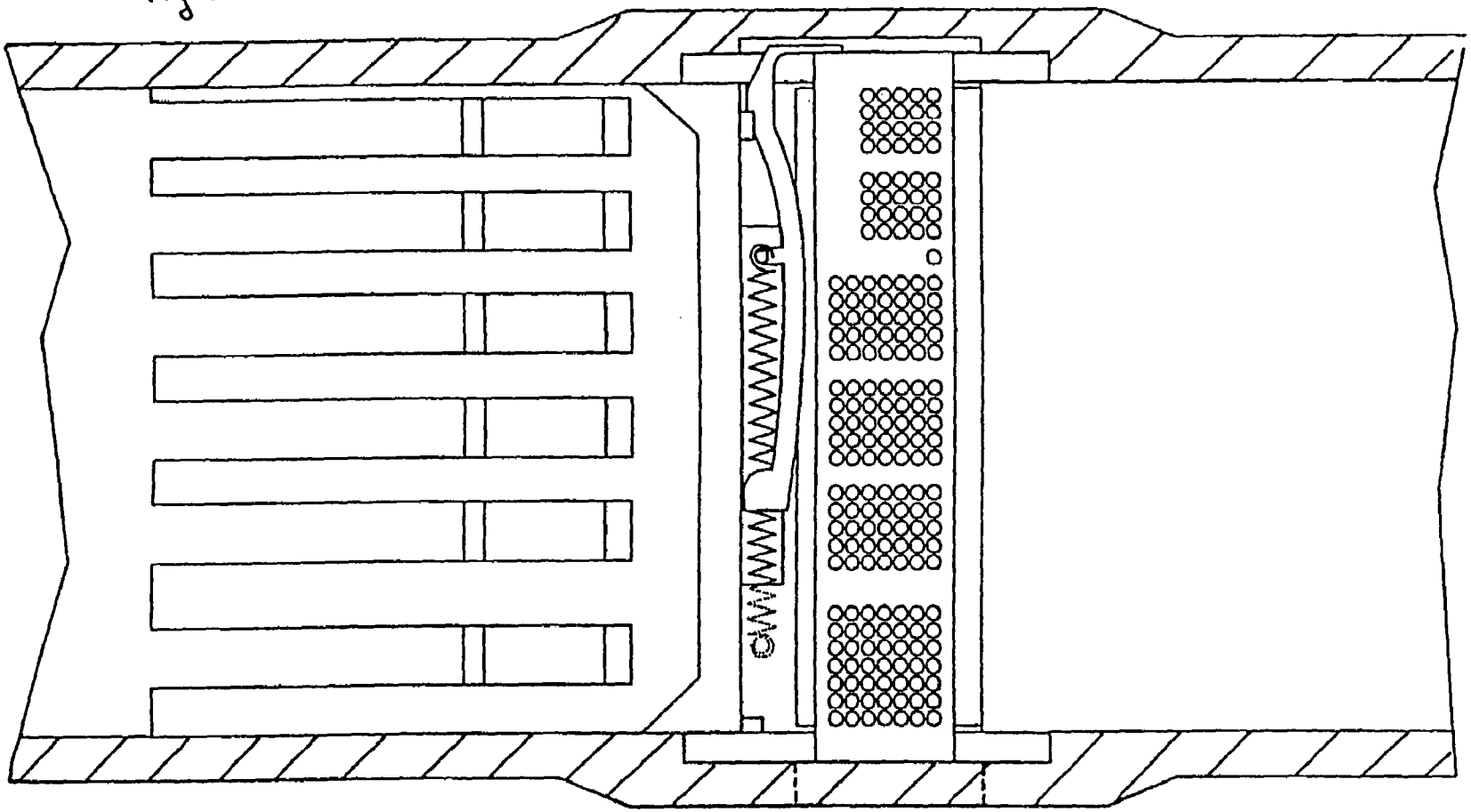
FIG. 22 shows a sectional view along the line EE of FIG. 17 with an alternative ejection mechanism in the latched position in a detailed view.
Figure 23:
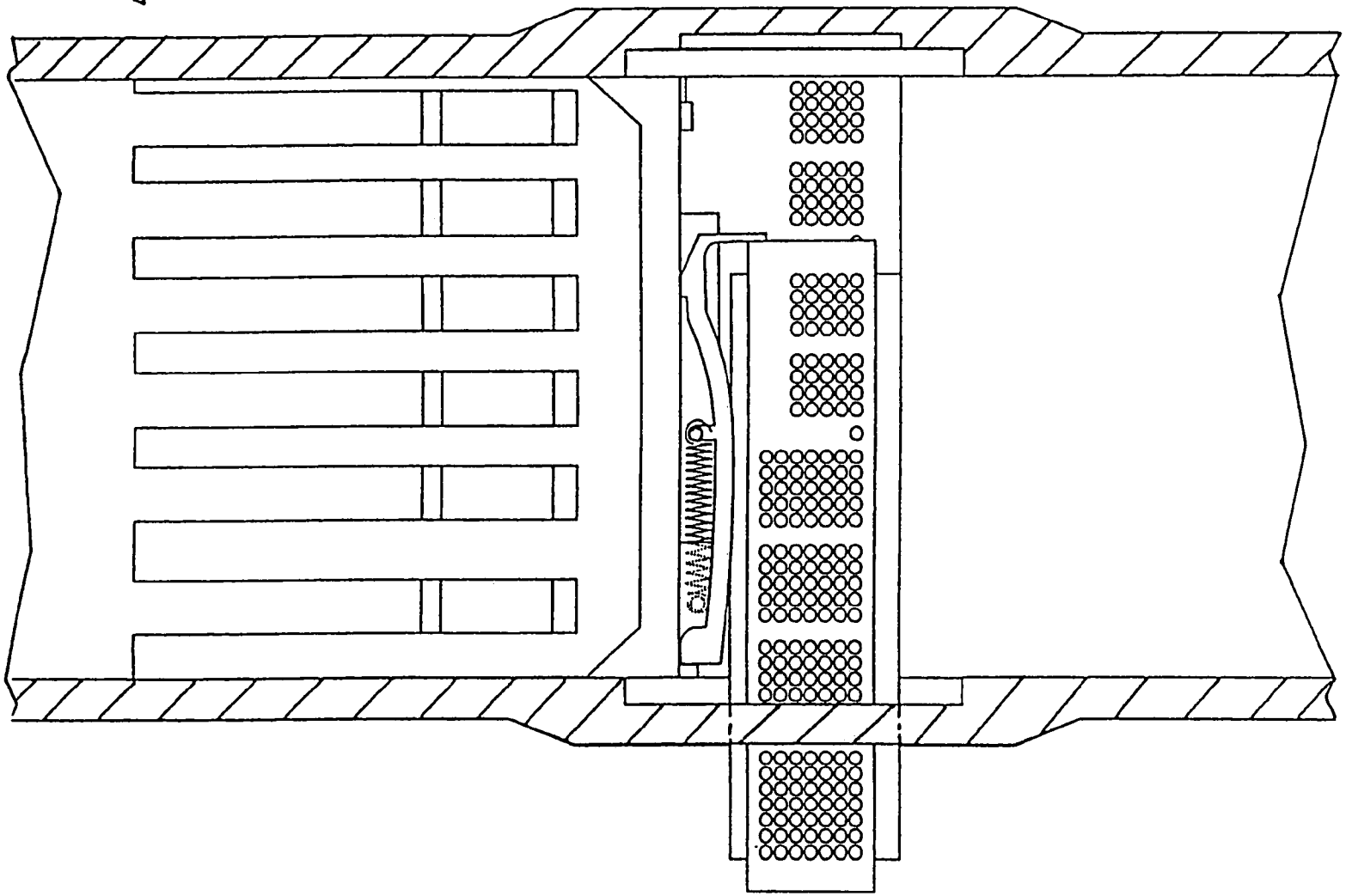
FIG. 23 shows a sectional view along the line EE of FIG. 17 with an alternative ejection mechanism and partly inserted or ejected apparatus for displaying characters in a detailed view.
Figure 24:
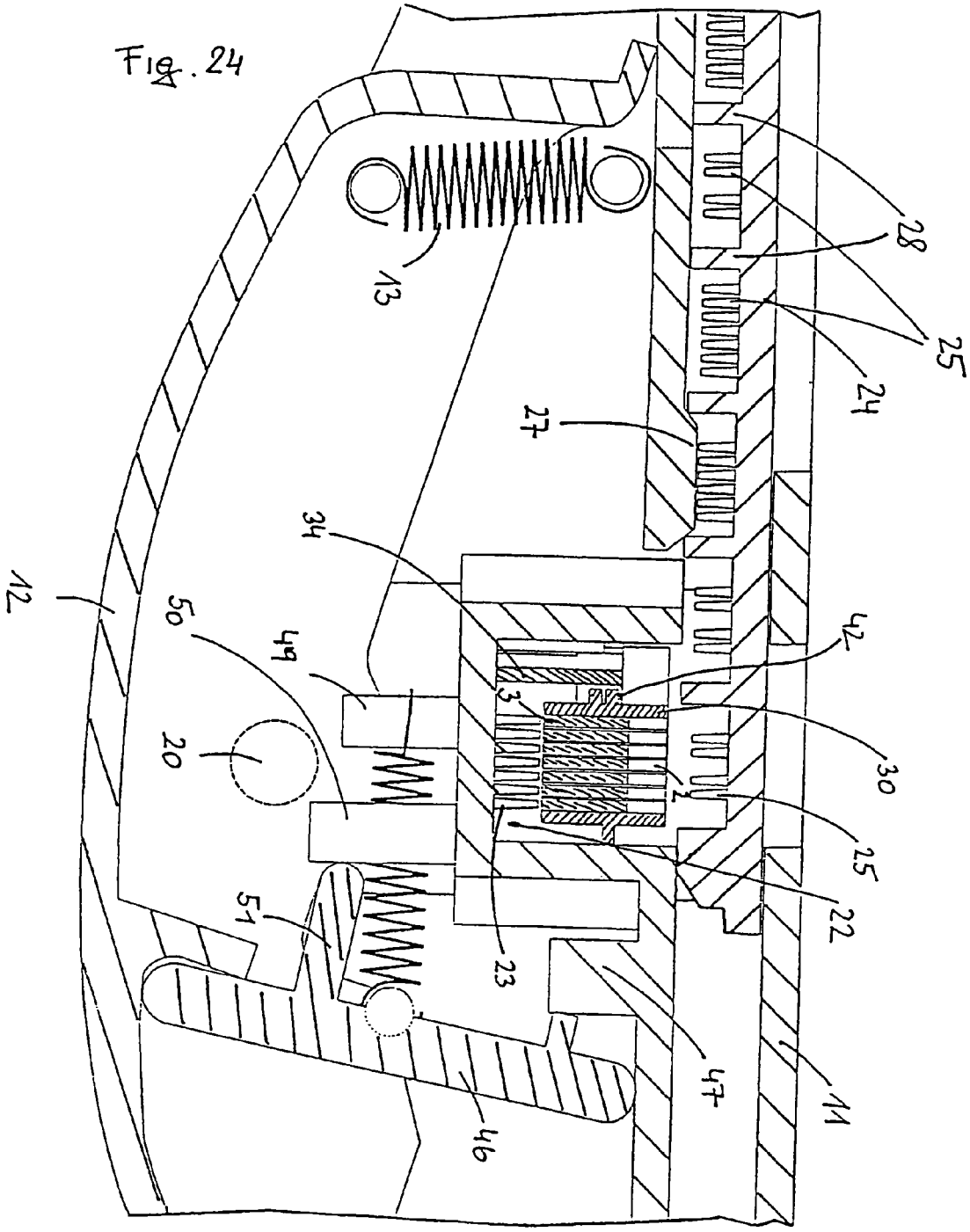
FIG. 24 shows a detailed sectional view of the setting chamber along the line CC of FIG. 16 after the calibration of the apparatus for displaying characters.
Figure 25:
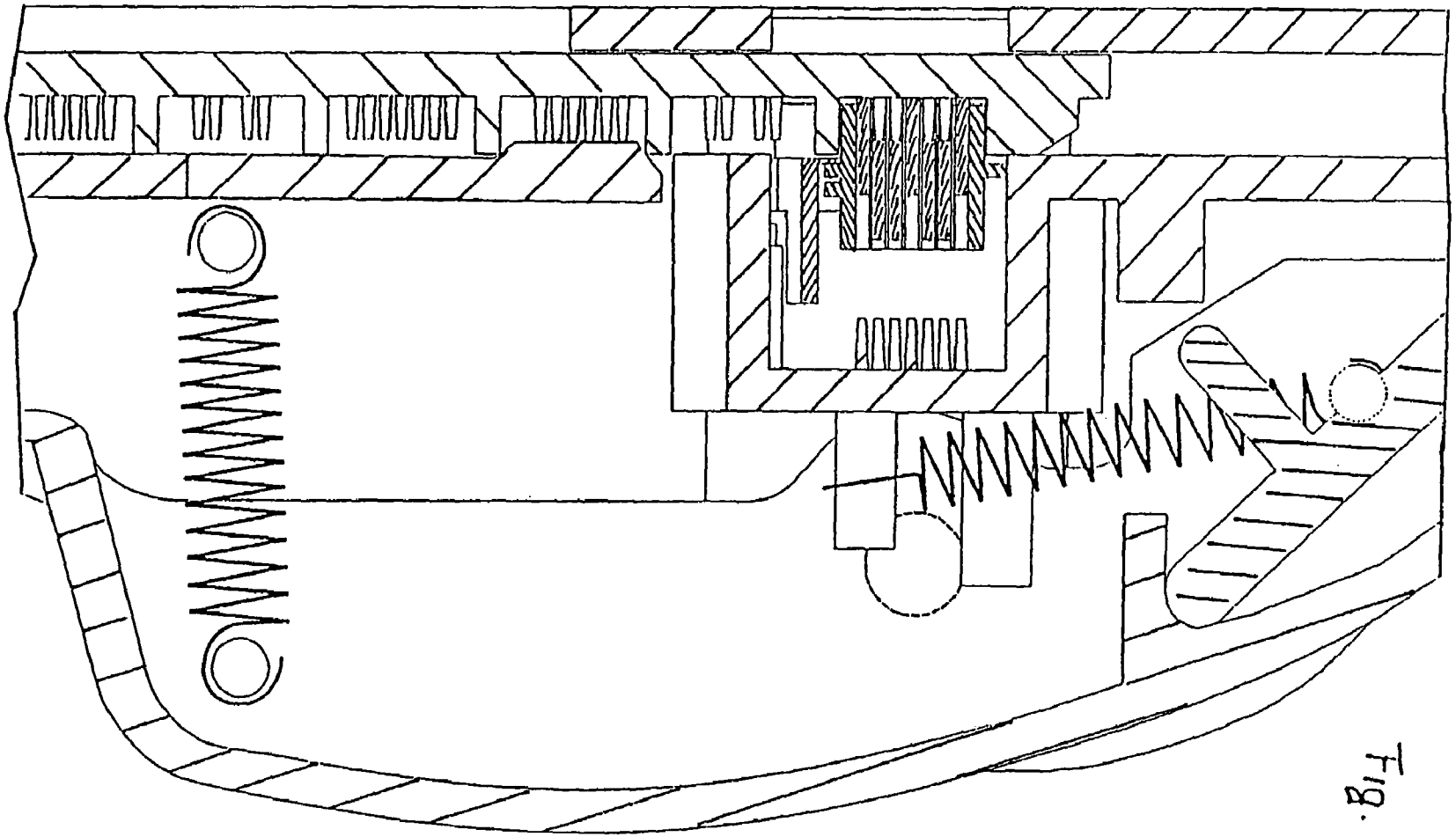
FIG. 25 shows a detailed sectional view of the setting chamber along the line CC of FIG. 16 during the setting of the characters.

FIG. 21 shows an alternative embodiment of an ejection mechanism of the setting chamber 22 in the idle position, i.e. without the inserted basic part 1. The pin-like calibrating elements 23 which project upwardly from the floor of the setting chamber 22 as well as the spring tongues 45 can be recognized very will in this illustration. In the illustrated idle position the ejection bracket 34 is pressed by the tension spring 41 against the floor of the setting chamber and against a stop 52 in the direction towards the insertion or ejection opening 32*a*, 33*a*. The ejection bracket 34 is further provided with an entrainment element 43 which can be brought into engagement with the face side of the basic part 1 of the price label 30. As a result of the insertion movement in the direction of arrow 36, the ejection bracket 34 is also moved via the entrainment element 43 in the direction 36 (FIG. 22). A hook 53 disposed on the ejection bracket 34 latches into a bridge 54 disposed on the wall of the setting chamber.

After completing the setting process as described above, the ejection bracket 34 is lifted by the vertical movement of the basic part 1 of the price label 30 (produced by the vertical movement of the brackets 21, 21*a*) which is upwardly in engagement with a second entrainment element 42 which is also disposed on the ejection bracket 34, as a result of which the hook is released from its engagement with the bridge 54.

After completing the setting process, the basic part 1 of the price label 30 moves downwardly again, with a further bridge 55 which is longer than the bridge 54 preventing a renewed latching of the hook 53 behind the bridge 54.

Once the setting apparatus is in the initial position again and the openings 32, 33 and 32*a*, 33*a* form a single continuous opening again, the ejection bracket 34 moves by spring 41 against the direction of insertion 36 until the same impinges on stop 52. As a result of the entrainment element 43, the basic part 1 of the price label 30 follows this movement and is thus pushed out of the setting chamber. By the bending of the ejection bracket 34 in the direction towards the opposite setting chamber wall, the basic part 1 of the price label 30 is pressed against the opposite setting chamber wall, as a result of which the ejection which occurs up to stop 52 is braked and falling out is prevented. The entrainment element 42 extends in this process over the entire length of the ejection bracket 34, as a result of which the insertion of the basic part 1 of the price label 30 into the setting chamber 22 always occurs in a straight line.

The upper holding part 12 is further provided with a floor 29 with a tongue-like end zone 56 (FIG. 12, FIG. 21). The latter can be bent downwardly, so that the setting template 24 can be pushed between bracket 57 and the tongue 56.

What is claimed is:

1. An apparatus for displaying letters, numbers or symbols, especially for marking the prices of goods, with a basic part having a visible surface and a back side opposite the visible surface, with at least one opening being disposed in the basic part, which opening is open on both sides and extends from the visible surface up to the opposite back side, and a movable member displaceably held in the at least one opening by a sliding seat having a constant cross section over the entire length thereof and providing a friction fit for the movable member, the movable member being displaceable from a first position in which a face of the movable member is visible from the visible surface of the basic part to a second position in which said face is disposed in a substantially non visible manner at a distance behind the visible surface in the basic part.

2. An apparatus as claimed in claim 1, characterized in that the sliding seat is achieved in such a way that the movable member is bent in an unstressed state at least in one section transversally to the longitudinal axis thereof and is aligned in a straight manner during the insertion into the at least one opening of the basic part.

3. An apparatus as claimed in claim 1, characterized in that the at least one opening and the moveable member have a circular cross section.

4. An apparatus as claimed in claim 1, characterized in that the at least one opening is arranged in a matrix.

5. An apparatus as claimed in claim 1, characterized in that the at least one opening has the shape of letters, numbers or symbols.

6. An apparatus as claimed in claim 1, characterized in that the at least one opening has a polygonal cross section.

7. An apparatus as claimed in claim 1, characterized in that the basic part is provided at its surface with a rail-like groove.

8. An apparatus as claimed in claim 1, characterized in that the basic part is provided with at least one additional continuous bore through which a pin can be inserted.

9. An apparatus as claimed in claim 1, characterized in that the basic part is provided with at least one additional opening into which a fixing element can be inserted.

10. An apparatus as claimed in claim 1, characterized in that the at least one opening has a stop bracket at the back side opposite of the visible surface.

11. An apparatus for displacing movable members in openings of a base part, with the movable members each being displaceable from a first position in which a face of the movable member is visible from a visible surface of the basic part to a second position in which said face is substantially disposed in a non visible way at a distance behind the visible surface in the basic part, characterized in that it comprises the following parts:

an upper holding part;

a lower holding part which in a middle part of the upper holding part is rotatably and displaceably fastened to the upper holding part, pin-like calibrating elements which are arranged according to the displaceable movable members, pin-like setting elements which are arranged according to characters to be set (positive or inverse), with the pin-like calibrating and setting elements being arranged in the upper holding part, and free face sides of the pin-like calibrating elements being directed against free face sides of the pin-like setting elements, and, by pressing together the upper holding part with the lower holding part, at first the pin-like calibrating elements and thereafter the pin-like setting elements are introduced into the openings of the basic part, whereby a desired alignment of the movable members is performed in the openings of the basic part.

12. An apparatus as claimed in claim 11, characterized in that the pin-like setting elements which are disposed in the upper holding part are arranged on at least one displaceable setting template.

13. An apparatus as claimed in claim 11, characterized in that it additionally comprises the following elements:

at least one tension spring which connects one end zone of the lower holding part which the upper holding part, a lever combination consisting of two levers rotatably connected at a connecting point, with one of the levers being rotatably fastened to the lower holding part and another one of the levers being rotatably fastened to the upper holding part, at least one tension spring which acts on the connection point of the two levers and is connected to the lower holding part, a setting chamber having a floor and being disposed in the upper holding part and into which the apparatus can be inserted, with the setting chamber being provided in the floor with the pin like calibrating elements which can be introduced into the openings of the basic part, several setting templates which are arranged displaceably next to one another in the upper holding part, with one section each of each setting template being disposable precisely above the pin-like calibrating elements in the setting chamber and with the pin-like setting elements which are arranged on the setting templates projecting into the setting chamber against the direction of the pin-like calibrating elements which are arranged on the floor, two brackets which are provided at least with one opening each and which are connected with the lower holding part, and are held in a vertically displaceable manner in the upper holding part.

14. An apparatus as claimed in claim 13, characterized in that an ejection bracket is arranged in the setting chamber, which bracket comprises two entrainment elements and two inclined shoulders on its lower side, with the ejection bracket being connected by way of a spring with the floor of the setting chamber, and a hook-like nose being arranged in the floor of the setting chamber which is arranged as a counterpart to one of the shoulders of the ejection bracket.

15. An apparatus as claimed in claim 13, characterized in that an ejection mechanism is arranged in the setting chamber, which mechanism comprises an ejection bracket which is movable in an insertion direction and which is pressed by a tension spring against the setting chamber floor and against a slop-in the direction towards an insertion or ejection opening, and the ejection bracket is provided with two entrainment elements, with one of the entrainment elements pretensioning the ejection bracket via the visible surface on the basic part by means of a hook which can be latched into a bridge and ejecting the basic part from the setting chamber by way of the tension spring.

16. An apparatus as claimed in claim 15, characterized in that the other entrainment element substantially extends over the entire length of the ejection bracket and can be brought into engagement with the visible surface of the basic part.

17. An apparatus as claimed in claim 16, characterized in that the ejection bracket is arranged on a setting chamber wall extending parallel to the direction of insertion.

18. An apparatus as claimed in claim 17, characterized in that the ejection bracket is bent in a direction towards an opposite setting chamber wall in order to press the basic part with a slight pressure against the opposite setting chamber wall in order to brake the ejection.

19. An apparatus as claimed in claim 11, characterized in that it additionally comprises the following elements:

at least one tension spring which connects the one end zone of the lower holding part with the upper holding part, a lever which is disposed floatingly between the upper holding part and the lower holding part and which rests with its two end zones on brackets which are disposed in said holding parts, with the lever being connected by way of a spring with the upper holding part, a setting chamber having a floor and being disposed in the upper holding part and into which the apparatus can be inserted, with the setting chamber being provided in the floor with the pin-like calibrating elements which can be introduced into the openings of the basic part, several setting templates which are arranged displaceably next to one another in the upper holding part, with one section each of each setting template being disposable precisely above the pin like calibrating elements in the setting chamber and with the pin-like setting elements which are arranged on the setting templates projecting into the setting chamber against the direction of the pin-like calibrating elements which are arranged on the floor, two brackets which are provided at least with one opening each and which are connected with the lower holding part by way of pins and are held in a vertically displaceable manner in the upper holding part.

* * * * *